United States Patent [19]

Matechuk

[11] Patent Number: 4,782,632

[45] Date of Patent: Nov. 8, 1988

[54] DRYWALL SANDER

[76] Inventor: William Matechuk, 314-20 Bradmon Drive, St. Catharines Ontario, Canada, L2M 3S5

[21] Appl. No.: 103,362

[22] Filed: Oct. 1, 1987

[51] Int. Cl.[4] ..... B24B 23/00

[52] U.S. Cl. ..... 51/180; 51/170 T; 51/273

[58] Field of Search ..... 51/180, 170 R, 170 T, 51/273

[56] References Cited

U.S. PATENT DOCUMENTS

| | | | |
|---|---|---|---|
| 2,612,648 | 10/1952 | Lagant | 51/180 |
| 2,722,090 | 11/1955 | Hasselquist | 51/180 |
| 3,722,147 | 3/1973 | Brenner | 51/180 |
| 3,948,005 | 4/1976 | Whitsett | 51/180 |
| 4,204,292 | 5/1980 | Lester et al. | 51/180 |
| 4,546,574 | 10/1985 | Blossick et al. | 51/180 |
| 4,663,796 | 5/1987 | Helling | 51/180 |

*Primary Examiner*—Roscoe V. Parker
*Attorney, Agent, or Firm*—McConnell and Fox

[57] ABSTRACT

A drywall sander comprises an electric motor and a rotary sanding head mounted at opposite ends of an arm so that the machine is balanced when the user grasps the arm just in front of the motor. The sanding is pivotally mounted on the arm so that it self-aligns with the surface being sanded and is connected to the motor by a flexible drive. The abrasive surface in said sanding head is surrounded by an enclosure to catch the dust.

5 Claims, 1 Drawing Sheet

DRYWALL SANDER

FIELD OF THE INVENTION

This invention relates to motorized sanders and in particular rotary sanders with electric drive.

DESCRIPTION OF THE PRIOR ART

In drywall construction it is necessary after taping and filling the joints between the panels to sand the joint to reduce it to the same level as the adjacent panels, and obscure any indication of a joint. In the past this has been done with manual sanders consisting simply of a supporting block and a section of abrasive paper mounted on the block. Because many of the joints to be sanded are above the reach of the workman it is necessary to provide and arm or handle on the block of sufficient length to enable the workman to sand ceiling joints and joints high up on a wall. It is evident that manual sanding is a slow and tedious process and produces a great deal of dust which is not only unpleasant but also may be dangerous to the health of the worker. Powered sanders have been used for other purposes, for example, vibratory, oscillating and rotary sanders have been used for various purposes but they have not proved to be suitable for drywall sanding.

SUMMARY OF THE INVENTION

In accordance with the present invention, a motor-driven disc sander is provided which, because of its construction, can conveniently be used both at the lower portions of walls and also on upper portions and on ceilings. At the same time, it is designed to minimize the release of dust from the sanding process and to align itself properly on the surface to ensure an even and flat finished surface.

These various objects are attained by mounting the rotary disc portion of the sander pivotally at the end of an extended arm. The drive motor is mounted adjacent the other end of the extended arm. An enclosure surrounds the rotating disc and is provided with a resilient edge which substantially seals the enclosure to the surface of the drywall during operation.

A clearer understanding of my invention may be had from consideration of the following description and drawings in which:

Figure 1:
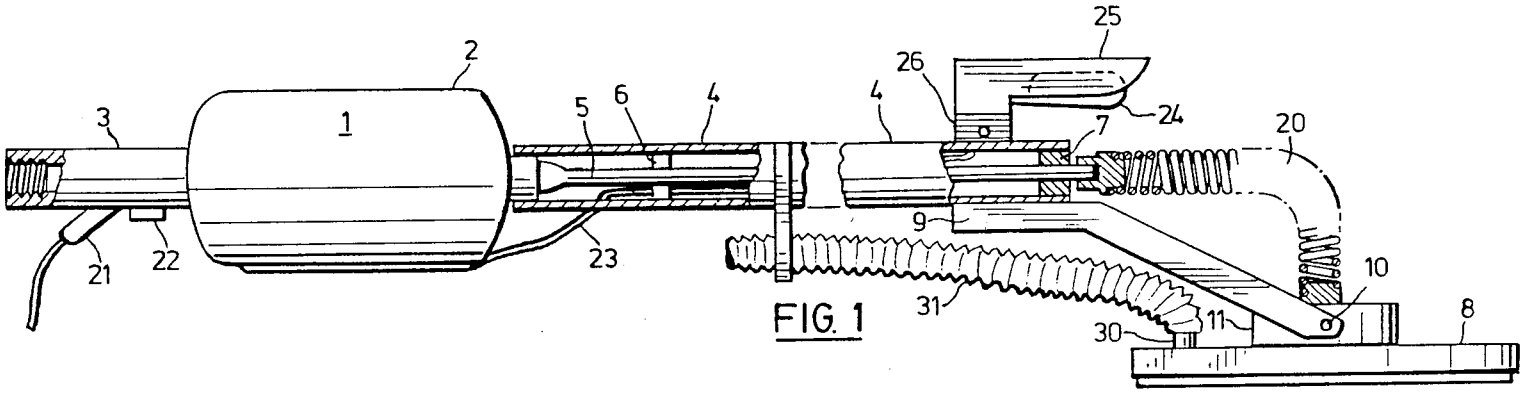
FIG. 1 is a view, partially in section, of a sander in accordance with my invention.
Figure 2:
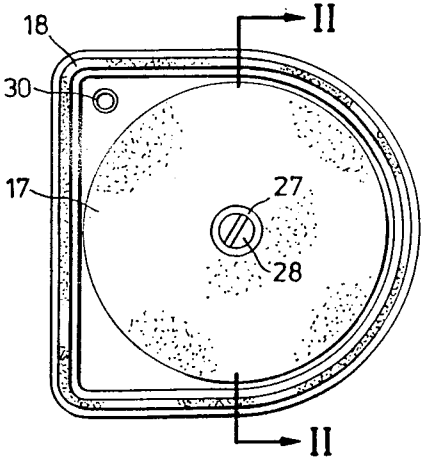
FIG. 2 is a view of the disc and enclosure of the sander being a portion of FIG. 1.
Figure 3:
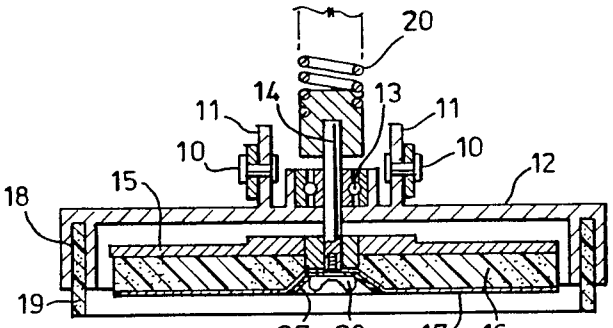
FIG. 3 is a sectional view of that portion of the sander shown in FIG. 2 at section line 2—2.

Considering first FIG. 1, it will be seen that a motor 1 having a motor housing 2 and a rear extension 3, extending behind the motor, is connected to a wand or extension 4. The rotating shaft of the motor is connected to a shaft 5 which is supported in bearings 6 within wand 4 and by an end bearing 7 at the end of wand 4. The sanding head 8 is mounted on a bracket 9, connected to wand 4, by means of pivots 10, more clearly shown in FIG. 2 which rotatably fasten the bracket 9 to a pair of brackets 11 mounted on the backing plate 12 of the sanding head 8. The disc 15 is mounted on a shaft 14 which in turn is supported by a bearing 13 in the backing plate 12. The shaft 14 is connected to shaft 5 by means of a flexible springdrive 20.

A sponge facing 16 is fastened to disc 15 and supports the sanding disc or abrasive disc 17 which is fastened to disc 15 by means of a wingbolt 28 and a cone-shaped washer 27. The sanding head 8 has a channel at its periphery, designated 18, in which is inserted a resilient member 19. The power to the motor is provided through a power cord 21 which enters the rear extension 3 and is connected through control switch 22 to motor 1. It is also connected through cable 23 to lamp 24 mounted within a protective shield 25 which is supported by a bracket 26 from the end of wand 4.

OPERATION

The operator will first mount a suitable abrasive disc on the surface of disc 15 supported by the facing 16 and held in place by the cone-shaped washer 27. The wingbolt is then tightened to secure the abrasive disc to the disc 15. With the power cord 21 connected to a suitable source, the operator then places the head against the surface of the drywall bridging the joint which is to be sanded. The resilient edge 19 substantially seals the head against the drywall. On pushing switch 22, the motor 1 rotates shaft 5 which, through flexible coupling 20, drives disc 15 and thus the abrasive disc 17. The rotatable pivoting mount of the head 8 on bracket 9 permits the head to maintain alignment with the surface of the drywall as the operator moves it up and down the joint. The illumination from lamp 24 permits the operator to view the joint and when he is satisfied that it has been reduced to a suitable condition he stops the motor by releasing the switch 22 and lowers the sander to discharge the abraded material into a suitable location, for example, a waste container.

When working in an overhead location, such as a ceiling, it will be evident that head 8 can be slipped over so that shaft 14 is substantially parallel to shaft 5 and the head 8 is at right angles to wand 4 and the operator can work substantially directly overhead. Because of the seal around the head, the dust produced by the sander is largely inhibited from falling back down onto the operator.

Because the motor is placed towards the rear of the wand and the sanding head is at the other end of the wand, the apparatus is substantially balanced and when grasped by the operator slightly ahead of the motor and around the rear extension 3, it is well balanced and minimizes the effort required to lift and manipulate the sander in locations well above the operator's head. However, in circumstances where extremely high ceilings or walls are encountered, it may be advisable to provide a further extension to wand 4 and, as may be seen, the rear extension 3 is provided with a threaded connector which permits an extension to be mounted. It will be appreciated, however, that with such an extension, the balance of the machine is not as good as it would be otherwise.

Electric motor 1 which drives the sander has not been described since it will vary depending on the specific size of disc it is desired to drive, however, for most purposes, it will be found that a small universal motor of fractional horsepower, such as normally used for electric drills, will be quite sufficient to drive the sanding disc at an adequate speed to permit rapid yet smooth sanding and finishing.

As will be seen, the provision of the pivoting head permits the sanding tool to be used in various location where the operator may not be able to actually reach the joint by hand and will permit continual self-alignment of the disc with the surface.

It will be understood that the resilient edge 19 may be made of various materials with various resiliencies. It will be understood, however, that the resilience of resilient edge 19 will determine the amount of force required to cause the abrasive disc to engage the surface and therefore, should be selected to ensure that the disc will engage the surface without undue force being applied to the head and yet will provide an adequate seal to prevent the abraded material from escaping from underneath the head.

While not shown, it will be understood that the various bushings and bearings must be provided with adequate dust shields because of the difficult environment in which they have to operate. It will also be understood that while the flexible drive 20 is shown as a spring drive, various other modes of applying the rotary motion from the motor to the disc could be used. This particular form seems to have particular advantage since it can be easily reversed when working overhead, however, other flexible drives universal joints, gears, a flexible cables could be used.

The length of wand 4 will depend upon the particular application, however, in most cases, it will be found that it should be approximately 4 feet long. The position of the motor and the head should be such that the apparatus is effectively balanced when grasped by the operator just below and above the motor, thus minimizing the amount of effort required to maneuver the equipment.

While the sanding head 8 may sufficiently large to contain the dust produced it may also be practical to attach the hose from an industrial vacuum cleaner to the head. This can be attained by providing a suitable connector at the lower or rear portion of the head. This connector can be a short tube such as tube 30 welded to plate 12. The hose 31 can be loosely attached to wand 4 to keep it out of way while sanding.

What I claim is:

1. A motorized sander comprising a rotary sanding head pivotally mounted on one end of a tubular arm, electric drive motor mounted on the other end of said arm, a shaft coupled to said drive motor and extending through said arm, said rotary sanding head including a rotary abrasive bearing disc, flexibly connected to said shaft and an enclosure surrounding the periphery of said disc, said enclosure extending slightly beyond the face of the abrasive on said disc, the edge of said enclosure comprising a resilient spongy material which resiliently engages the surface being sanded.

2. A motorized sander as claimed in claim 1, wherein said shaft is rigid and is connected to said sanding head by a flexible spring drive.

3. A motorized sander as claimed in claim 1 wherein said motor is provided with a handle extending from that end of the motor not connected to said arm.

4. A motorized sander as claimed in claim 1, including means to extract air from said enclosure.

5. A motorized sander comprising a rotary sanding head including a rotary abrasive bearing disc and an enclosure surrounding said disc, said head being pivotaly mounted on one end of a tubular arm, an electric motor having a shaft and mounted at the other end of said arm with its shaft concentric with, and extending into, said arm, a driveshaft connected to the said shaft of said motor and extending through said arm and supported concentrically therein, a flexible spring drive connected between said driveshaft and said disc, said enclosure surrounding said disc but leaving the abrasive on said disc exposed, the edge of said enclosure including a resilient spongy portion extending slightly beyond the plane of the said abrasive.

* * * * *